United States Patent [19]

Eberhardt et al.

[11] 4,386,254

[45] May 31, 1983

[54] ROCKER SWITCH

[75] Inventors: Noel Eberhardt; Stewart Carl, both of Cupertino, Calif.

[73] Assignee: Timex Corporation, Waterbury, Conn.

[21] Appl. No.: 273,786

[22] Filed: Jun. 15, 1981

[51] Int. Cl.[3] ..... H01H 3/00; H01H 3/12

[52] U.S. Cl. ..... 200/339; 200/302

[58] Field of Search ..... 200/339, 302, 330, 298

[56] References Cited

U.S. PATENT DOCUMENTS

| | | | |
|---|---|---|---|
| 3,471,670 | 10/1969 | Norden | 200/339 |
| 4,031,348 | 6/1977 | Eberhardt | 200/302 |

FOREIGN PATENT DOCUMENTS

| | | | |
|---|---|---|---|
| 564253 | 7/1975 | Switzerland | 200/339 |
| 581521 | 11/1977 | U.S.S.R. | 200/330 |

*Primary Examiner*—Willis Little

*Attorney, Agent, or Firm*—William C. Crutcher; Joseph A. Biela

[57] ABSTRACT

Disclosed is a rocker switch for an electrical device, in particular an electronic watch. As adapted for use with a watch, the rocker switch is preferably disposed in a recess in the watchcase and includes a manually-operable actuator bar having a pair of spaced legs projecting through access holes into the watercase to alternately engage a pair of switch contact means when the actuator bar is rocked. Each leg of the actuator bar preferably includes an offset lip engaging the watchcase from the inside to retain the actuator bar in the recess. Resilient washer means is positioned around the legs between the actuator bar and the bottom of the watchcase recess in sealed contact therewith to provide switch sealing means and return-spring means for the actuator bar.

23 Claims, 14 Drawing Figures

ROCKER SWITCH

FIELD OF THE INVENTION

The present invention relates to a switch construction useful for an electronic watch or other device and, in particular, to a rocker switch comprising few components.

BACKGROUND OF THE INVENTION

In the use of electronic watches, particularly, multifunction digital watches, it is necessary to have switches which enable the user of the watch to select the desired display function, or to set the information being displayed or to illuminate the display by activating lighting means. In the past, electronic watches have often employed one or more push-button switches to control the watch functions. These push-buttons most often employ a dynamic seal which is necessary to minimize or prevent moisture and other contaminants from entering the interior of the watch where delicate electronic components can be adversely affected.

Oftentimes, the push-button assembly includes a tube having an axially tapered bore for receiving a plunger. An O-ring is disposed around the plunger and a spring is used to provide tension on the push-button. Typical prior art push-buttons are shown in the U.S. Pat. No. 3,575,212 to Zellweger et.al. issued Sept. 11, 1973, U.S. Pat. No. 3,783,607 to Feurer issued Jan. 8, 1974 and U.S. Pat. No. 4,023,002 to Wuthrich issued May 10, 1977 as well as others. Switches of the typical push-button type are disadvantageous in that they are relatively high in cost, provide less than adequate sealing and detract from the overall appearance of the watch.

A push-button switch which sought to remedy these deficiencies is described in U.S. Pat. No. 4,031,348 issued June 21, 1977 to Noel Eberhardt. This switch comprises a single push-button member which includes a button and a shaft, the shaft being disposed within a bore and counterbore in a watchcase. A resilient, annular washer is disposed about the shaft of the push-button member within the counterbore and is shaped to sealingly engage the counterbore and push-button, functioning as both sealing means and return spring means for returning the push-button to the initial position after actuation.

Other types of switches for electronic watches have been devised by prior art workers. For example, a thin touch-type switch is disclosed in U.S. Pat. No. 4,241,246 to Lugaresi issued Dec. 23, 1980. Switch constructions for electronic calculator watches are disclosed in U.S. Pat. No. 4,072,004 to Tanaka et.al. issued Feb. 7, 1978 and in U.S. Pat. No. 4,184,321 to Tarusawa issued Jan. 22, 1980.

Switch constructions apparently for other uses are disclosed in the following patents. U.S. Pat. No. 3,999,287 to Lockard issued Dec. 28, 1976 discloses a rocker switch in which a pair of spaced contacts are embedded in a rocker arm and resiliently grip a diode therebetween that controls current direction of the completed circuit. U.S. Pat. No. 4,121,074 to Orcutt et.al. issued Oct. 17, 1978 involves a pressure responsive switch incorporating a rocker member for acting on a contact arm. U.S. Pat. No. 4,172,973 to Sano issued Oct. 30, 1976 discloses a seesaw switch with a light-emitting diode mounted upon a rockable member.

SUMMARY OF THE INVENTION

The present invention relates to a rocker switch especially useful for controlling the functions of an electronic timepiece or other electrical device. The rocker switch of the invention is advantageous as a result of its low cost, simple construction, small size, styling flexibility and resistance to moisture penetration.

The rocker switch of the invention includes an actuator bar preferably disposed in a recess in the watchcase or housing of the electrical device. The actuator bar typically includes an accessible first side by which the bar can be rocked and a second side facing that part of the housing forming the bottom of the recess. The second side includes a pair of spaced projecting legs extending through a pair of access holes in the watchcase or housing to actuate switch contact means therein when the actuator bar is rocked. Preferably, the actuator bar includes a travel-limit boss on the second side outwardly disposed from each projecting leg near opposite ends of the bar to limit the rocking movement within limits and a stop boss positioned on the second side intermediate the legs to prevent simultaneous engagement of both legs with the switch contact means. Retaining means, preferably associated with the projecting legs, is provided to hold the actuator bar in the recess. The retaining means preferably comprises an offset lip on each leg of the actuator bar for engaging the watchcase or housing from the inside.

The rocker switch of the invention also includes resilient washer means positioned between the second side of the actuator bar and the housing around the legs of the actuator bar. The washer means includes portions in sealed contact relation with the second side of the actuator bar and the housing to provide a rocker switch construction resistant to moisture penetration. The resilient washer means typically is made of silicone rubber and further functions as return-spring means for the actuator bar. In one embodiment, a pair of resilient annular washers is provided with one washer disposed around one actuator leg and the other around the other actuator leg. In another embodiment, a resilient washer is provided with outer portions disposed around each actuator leg and an intermediate portion having a boss molded thereon.

A rocker switch with above-enumerated advantages is provided and may comprise only three components.

DESCRIPTION OF THE PREFERRED EMBODIMENTS

Figure 1:
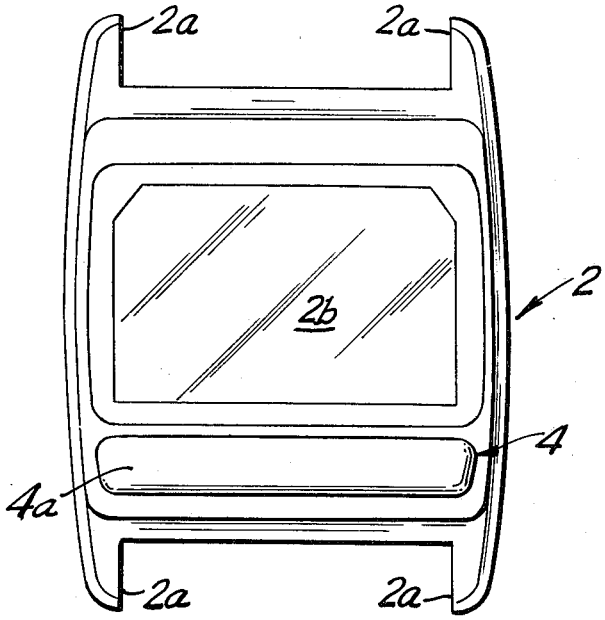
FIG. 1 is a top plan view of an electronic digital watch having the rocker switch of the invention to control watch functions.

FIG. 1 shows an electronic digital watch with the rocker switch of the invention. The watch includes a case or bezel 2 having pairs of spaced lugs 2*a* on opposite sides for engagement to a watch strap or band in well known fashion. The case 2 includes a generally rectangular window 2*b* of transparent plastic or glass through which the digital display can be viewed. Of course, the display can be selected from any of the well known types such as a twisted nematic liquid crystal display, guest host display and the like and may be digital, analog (rotating hands) or various combinations thereof.

Figure 2:
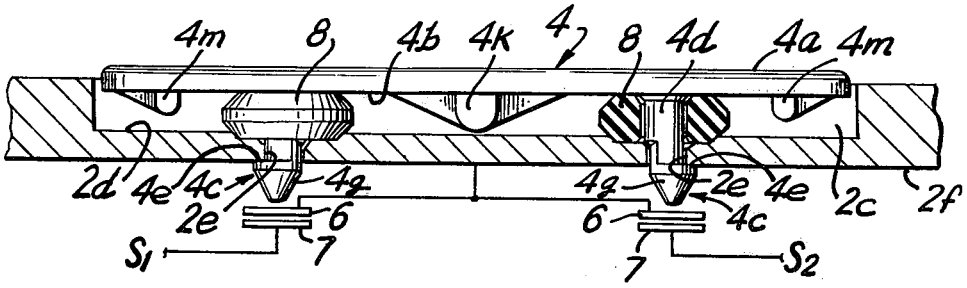
FIG. 2 is a partial side elevation of the rocker switch with the case and one resilient washer broken away.
Figure 3:
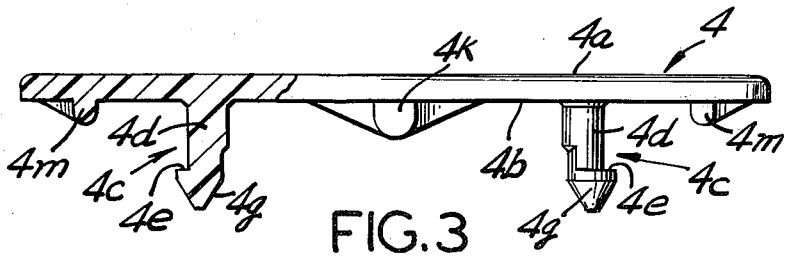
FIG. 3 is a side elevation of the actuator bar.
Figure 4:
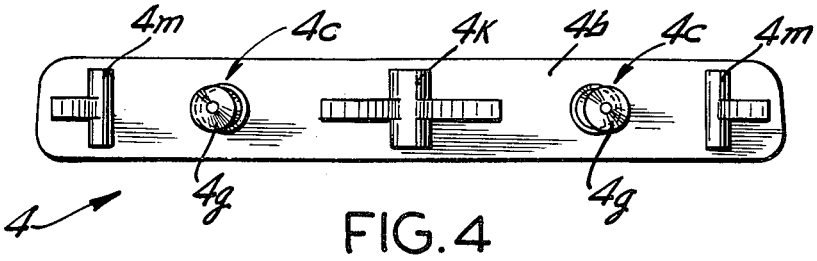
FIG. 4 is a bottom plan view of the actuator bar.

In the top plan view of FIG. 1, the only part of the rocker switch which is visible is the manually-operated actuator bar 4 having an accessible first side 4*a* adapted to be pressed near the ends by the operator to rock the bar as described hereinafter. FIG. 2 shows other features of the rocker switch as well as the elongated watchcase recess 2*c* in which the switch is disposed. For example, it is seen that the actuator bar includes a first side 4*a* already mentioned which is accessible for pressing by the operator and a second side 4*b* facing the bottom wall 2*d* of the recess and from which second side depend several important features including a pair of projecting legs 4*c* which extend through access holes 2*e* into the interior of the watchcase. As shown in FIGS. 3 and 4, each leg includes a generally cylindrical portion 4*d* with an offset lip 4*e* which engages (snap-fits) against the interior wall 2*f* of the watchcase and retains the actuator bar in the recess 2*c*. In lieu of the offset lip, a snap-ring (not shown) may be attached around the bottom of each leg to function as retaining means to retain the actuator bar in the recess, although this embodiment adds to the number of switch components. Other retaining means known to those skilled in the art may also be used.

Each leg is shown terminating in a converging conical portion 4*g* adapted to press on upper switch contact 6 and force it into contact with lower switch contact 7 comprising switches $S_1$ and $S_2$ of the watch circuitry. The legs 4*c* thus are used to alternately make or break electrical contact at both switches $S_1$ and $S_2$ for selectively controlling, for example, watch functions such as seconds, timer, alarm, date information, etc., or for controlling lighting means to illuminate the display. Of course, the legs 4*c* may also be employed to make or break electrical connection between a single switch contact and a component of the watch such as the bezel or caseback which is selected to be watch circuit ground. The electronic circuitry for effecting the aforementioned functions is well known to those skilled in the art and forms no part of the invention. The actuator bar 4 may be insulative such as molded thermoplastic or conductive such as a machined, cast or stamped metallic components as required in the particular circuitry selected. In addition, the actuator bar may be a unitary molded or formed part or an assembly of one or more parts, e.g. separate legs attached to the actuator bar.

Located between the depending legs 4*c* of the actuator bar is a central stop boss 4*k* which prevents simultaneous engagement of both legs with upper contact plates 6 by abuting against bottom wall 2*d* of the watchcase recess when the actuator bar is improperly pressed. Near opposite ends of the actuator bar outwardly disposed from the legs 4*c* are travel-limit bosses 4*m* which limit the rocking movement of the actuator bar within prescribed limits. Of course, an actuator bar and corresponding recess with other than an elongated shape may be employed so long as the bar can be rocked.

Figure 5:
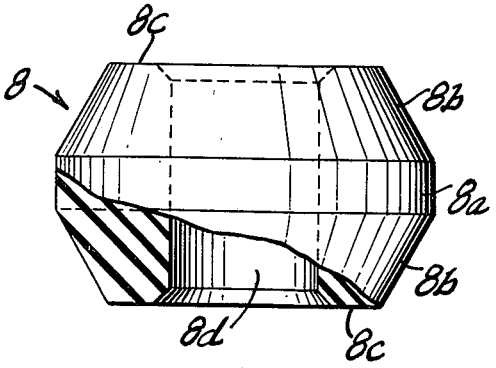
FIG. 5 is a side elevation partially broken away of one type of resilient washer useful in the rocker switch.

The resilient annular washers 8 are shown in FIG. 2 positioned around the cylindrical portion of legs 4*c* in sealed contact at their end portions with the second surface 4*b* of the actuator bar and the bottom wall 2*d* of the recess. The resilient washer is shown in more detail in FIG. 5 as comprising a central cylindrical portion 8*a* and converging conical end portions 8*b*, each of which terminates in an annular sealing surface 8*c* adapted to seal against the actuator bar and bottom recess wall as shown in FIG. 2. The longitudinal dimension of the washers (distance between annular sealing surfaces 8*c*) is selected in relation to the distance between the second surface 4*b* of the actuator bar and bottom wall of the recess such that each washer is in a slightly compressed condition when the offset lips 4*e* of legs 4*c* are snap-fitted against the interior wall 2*f* of the watchcase (FIG. 2). Each washer is made of resilient material such as silicone rubber to provide proper sealing and also to provide proper return spring action to return the bar to its original position shown in FIG. 2 after one end is pressed to make contact at switch contact means $S_1$ or $S_2$. The converging conical end portions 8*b* enhance the resiliency of the washers. It is apparent that each washer includes a central bore 8*d* adapted to receive the cylindrical portion of a respective depending leg 4*c* in non-sealed relation, although sealed contact may be provided therebetween, and further includes conically-diverging counter bores at opposite ends to receive similarly shaped portions of each leg 4*c*.

Figure 6:
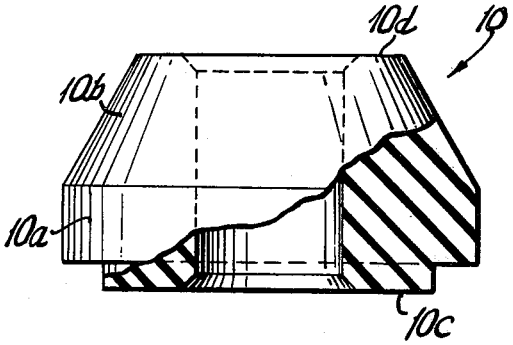
FIG. 6 is a side elevation partially broken away of another type of useful resilient washer.

Of course, other washer configurations may be employed, e.g., as shown in FIG. 6. The annular washer 10 shown includes a central cylindrical portion 10*a*, an upper conically converging end portion 10*b* and a lower cylindrical portion 10*c*. The conically converging portion 10*b* terminates in an annular surface 10*d* that sealingly contacts the second surface of the actuator bar and the lower cylindrical portion terminates in a similar annular surface that sealingly engages the bottom wall of the recess. This embodiment includes central bore and conically-diverging end counterbores at opposite ends similar to those provided in the embodiment of FIG. 5.

Figure 7:
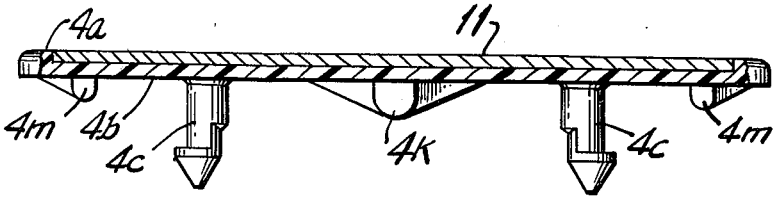
FIG. 7 is a side elevation partially broken away of the actuator bar with a decorative insert in its first side.
Figure 8:
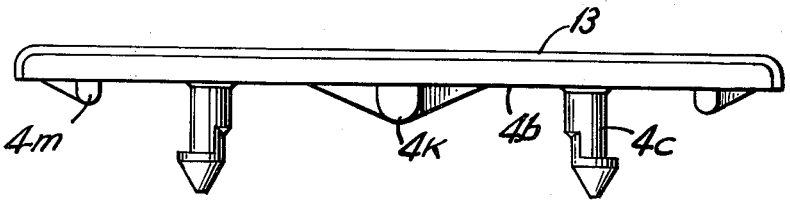
FIG. 8 is a side elevation of the actuator bar with a decorative coined cap on the first side.
Figure 9:
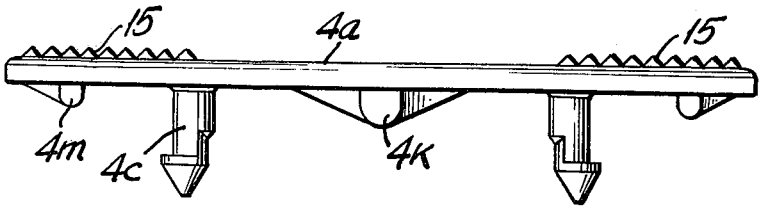
FIG. 9 is a side elevation of the actuator bar with serrations on the first side.

The actuator bar 4 is shown in FIGS. 7–9 with various styling treatments applied to the accessible first side which is visible to the switch operator. For example, in FIG. 7, a decorative metal insert 11 is provided in a recess in the first surface. A decorative coined metal cap 13 is attached over the first surface in FIG. 8. In FIG. 9 the opposite ends of the actuator bar are provided with serrated portions 15 either molded or cut into the first surface to provide tactile areas for operation of the rocker switch. Of course, the color of the actuator bar may be coordinated with that of the watchcase, display, strap, band or other features of the watch.

Figure 10:
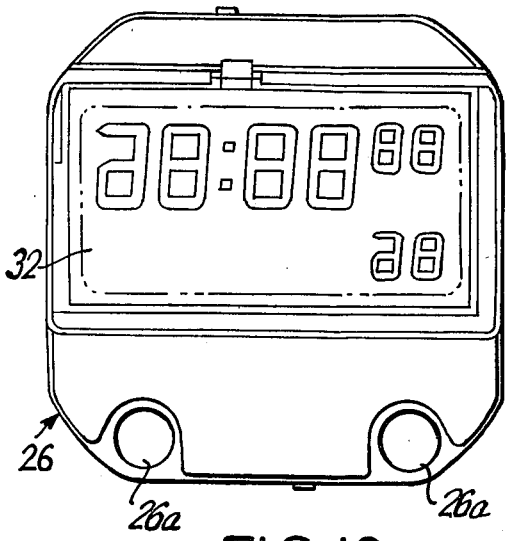
FIG. 10 is a top plan view of a module for use with the rocker switch.
Figure 11:
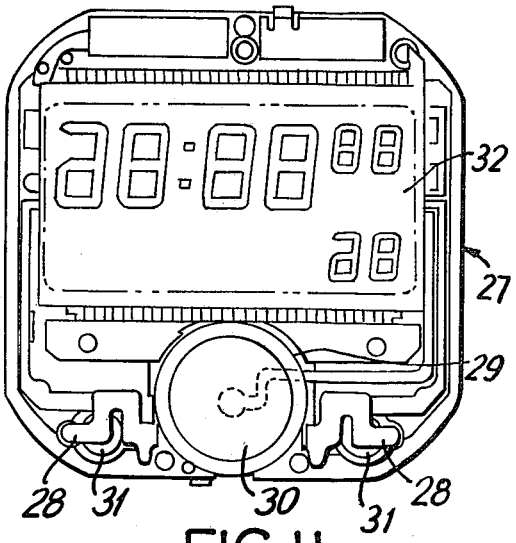
FIG. 11 is a plan view of the module with the front frame removed to show the switch contacts in more detail.

Typically, in the above-described embodiment, the upper switch contact 6 and lower switch contact 7 are thin metallic members mounted in a module, for example, as shown in FIGS. 10 and 11 comprising a front frame 26 and rear frame 27. The module in turn is mounted in the watchcase which may comprise several component parts. As shown, there are two openings 26*a* in the front frame. These are aligned with the access holes 2*e* in the bottom of the case recess 2*c* and the projecting legs 4*c* extend therethrough to engage upper switch contacts 28 mounted between the front and rear frames. The upper switch contacts 28 are each in the form of thin flexible wings extending from a more or less semi-circular ring 29 which extends partially around and in contact with the battery 30. Positioned below the upper switch contacts 28 are lower switch contacts 31 in the form of circular metallic pads connected by appropriate leads to an integrated circuit chip (not shown) mounted on the bottom frame 27 beneath the electrooptical display 32 such as a well known twisted nematic liquid crystal display. The upper switch contacts 28 are formed of a resilient metallic sheet such as spring temper Type 302 stainless steel so that they can be depressed into engagement with lower switch contacts 31 and yet return to the original position when the projecting leg of the actuator bar is withdrawn by return spring action of the resilient washers.

Figure 12:
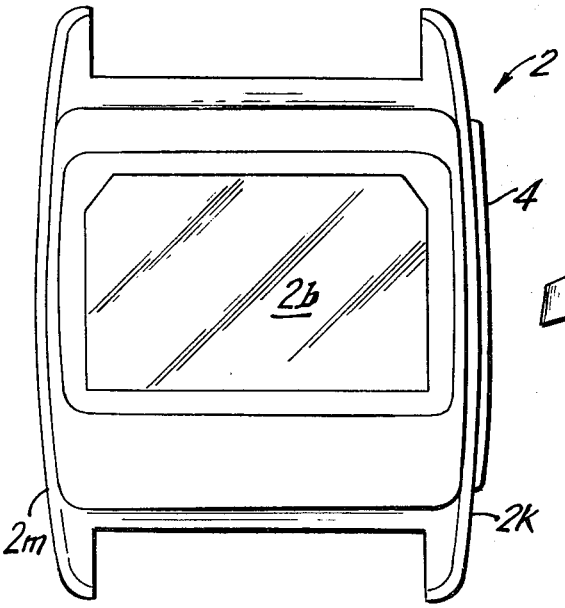
FIG. 12 is a plan view showing the rocker switch on the side of a watchcase.
Figure 13:
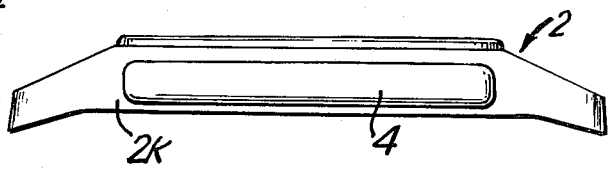
FIG. 13 is a side elevation showing the side-mounted rocker switch.

Although the embodiment described above illustrates the rocker switch on the top or front of the watch adjacent the display, it should be apparent that the switch could be located on a side wall or other areas of the watchcase and does not necessarily have to be located in recess. FIGS. 12 and 13 show the rocker switch actuator bar 4 on a side wall 2*k* of the watchcase 2 to provide a different aesthetic appearance. Of course, a similar rocker switch could also be positioned in the opposite-facing side wall 2*m* or possibly in the back of the watchcase.

And it will be apparent to those skilled in the art that the rocker switch of the invention can be used with other electrical devices such as clocks, calculators, appliances and the like.

Figure 14:
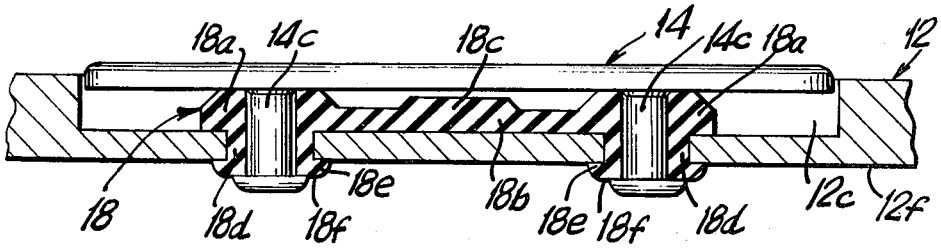
FIG. 14 is a partial cross-section through another rocker switch embodiment of the invention.

In another embodiment of the invention illustrated in FIG. 14, a resilient washer 18 of more complicated shape is employed to serve additional functions. The washer includes molded outer portions 18*a* around the legs 14*c* of the actuator bar 14 to function as sealing means and return spring means as described hereinabove. The outer portions 18*a* are connected together by an intermediate portion 18*b* which includes an upwardly projecting boss 18*c* to function as a stop to prevent simultaneous engagement of both legs 14*c* with the switch contacts (not shown) inside the watchcase 12. The outer portions 18*a* of the washer also include depending legs 18*d* extending through the access holes in the bottom of recess 12*c* and having outwardly extending lips 18*e* to engage the case inside wall 12*f*. The legs 14*c* of the actuator bar in turn have outwardly extending lips to engage the terminal ends 18*f* of the washer legs as shown to retain the actuator bar in the recess.

While there have been described herein certain preferred embodiments of the invention, other changes or modifications thereto may occur to those skilled in the art and it is desired to cover in the appended claims all such modifications as fall within the true spirit and scope of the invention.

We claim:

1. A rocker mechanism for use in an electronic watch having switch contact means enclosed within a housing, comprising:

(a) a wall of said housing defining a pair of spaced access holes providing access to the switch contact means inside said housing, (b) a manually-operable actuator bar disposed adjacent the wall and having an accessible first side by which said actuator bar can be manually rocked and having a second side spaced from and facing the wall with a pair of spaced apart legs projecting from said second side through the access holes such that each leg can be urged to actuate said switch contact means by rocking said actuator bar, (c) retaining means associated with said actuator bar for retaining the actuator bar legs in the wall, (d) resilient washer means disposed around each of the legs between the second side of the actuator bar and the wall with portions of the washer means in contact with said second side and wall to provide sealing of said access holes and return-spring action for the actuator bar, and (e) means associated with said actuator bar for limiting the movement of said bar when said switch contact means has been actuated.

2. The combination of claim 1 wherein said limiting means comprises stop means on the second side of said bar between the spaced apart legs to prevent both legs from being simultaneously brought into contact with the switch contact means.

3. The combination of claim 2 wherein the stop means is a boss extending from the second side toward and spaced from the wall.

4. The combination of claim 1 wherein said limiting means comprises a travel-limit boss disposed on the second side of said bar outwardly from each leg to limit the rocking movement of the actuator bar.

5. The combination of claim 1 wherein the retaining means is associated with the legs of the actuator bar.

6. The combination of claim 5 wherein the retaining means comprises a lip formed on each leg to engage the housing from the inside, thereby retaining the actuator bar in the wall.

7. The combination of claim 1 wherein the washer means comprises a pair of annular washers, one washer being disposed around one projecting leg of the actuator bar and the other washer being disposed around the other projecting leg.

8. The combination of claim 1 wherein the washer means comprises a washer having spaced apart outer protions around the projecting legs of the actuator bar and an intermediate portion connecting the outer portions.

9. The combination of claim 8 wherein the intermediate portion of the washer includes a boss extending toward the second side of the actuator bar.

10. The combination of claim 8 wherein the outer portions of the washer each include a projecting washer leg extending through a respective one of the access holes in the wall, each washer leg terminating in a lip engaging the housing from the inside, and wherein the projecting legs of the actuator bar each include a lip for engaging the washer leg lip to retain the actuator bar in the wall.

11. A rocker mechanism in combination with an electronic watch having a housing, said combination comprising:

(a) a wall of said housing defining a recess and a pair of spaced access holes in the bottom of the recess providing access to the switch contact means inside said housing, (b) switch contact means disposed within said housing, (c) a manually-operable actuator bar disposed in the recess and having an accessible first side by which said actuator bar can be manually rocked and having a second side spaced from and facing the bottom of the recess with a pair of spaced apart legs projecting from said second side through the access holes such that each leg can be urged into contact with said switch contact means by rocking said actuator bar, (d) retaining means associated with the legs for retaining the actuator bar in the recess, (e) resilient washer means disposed around each of the legs between the second side of the actuator bar and the bottom of the recess with portions of the washer means in contact with said second side and bottom of said recess to provide sealing of said access holes and return-spring action for the actuator bar, and (f) means associated with said actuator bar for limiting the movement of said bar when said switch contact means has been actuated.

12. The combination of claim 11 wherein the retaining means comprises a lip formed on each leg to engage the housing from the inside, thereby retaining the actuator bar in the recess.

13. The combination of claim 11 wherein the washer means comprises a pair of annular washers, one washer being disposed around one projecting leg of the actuator bar and the other washer being disposed around the other projecting leg.

14. The combination of claim 11 wherein the washer means comprises a washer having spaced apart outer portions around the projecting legs of the actuator bar and an intermediate portion connecting the outer portions.

15. A rocker switch in combination with an electronic watch having time display means and a pair of switch contact means housed inside a watchcase, the time display means being visible through a window in a side of the watchcase, said combination comprising:

(a) a wall of said watchcase defining an elongated recess and a pair of spaced access holes in the bottom of the recess providing access to the switch contact means inside said watchcase, (b) an elongated, manually-operable actuator bar disposed in the recess and having an accessible first side by which said actuator bar can be manually rocked and having a second side spaced from and facing the bottom of the recess with a pair of spaced apart legs projecting from said second side through the access holes such that each leg can be urged alternately into contact with a respective one of the switch contact means by rocking said actuator bar, (c) retaining means associated with the legs for retaining the actuator bar in the recess, and (d) a resilient annular washer disposed around each of the legs between the second side of the actuator bar and the bottom of the recess with end portions of each washer in contact with said second side and bottom of said recess to provide sealing of said access holes and return-spring action for the actuator bar.

16. The combination of claim 15 wherein the retaining means comprises an offset lip formed on each leg to engage the watchcase from the inside, thereby retaining the actuator bar in the recess.

17. The combination of claim 15 wherein the recess of the watchcase and the actuator bar disposed therein are located on the same side of the watchcase as the window for viewing said time display means.

18. The combination of claim 15 wherein the recess of the watchcase and the actuator bar disposed therein are located on a side of the watchcase different from the side where the window for viewing the time display means is located.

19. The combination of claim 15 wherein the actuator bar includes stop means on the second side between the spaced legs to prevent both legs from being simultaneously brought into contact with the switch contact means and further includes a travel-limit boss on the second side outwardly disposed from each leg to limit the rocking movement of the actuator.

20. The combination of claim 15 wherein the accessible first side of the actuator bar includes decorative means.

21. The combination of claim 20 wherein the decorative means comprises an insert in said first side.

22. The combination of claim 20 wherein the decorative means comprises a cap over said first side.

23. The combination of claim 20 wherein the decorative means includes serrations in said first side.

* * * * *